US006349932B1

(12) United States Patent
Suzuki

(10) Patent No.: US 6,349,932 B1
(45) Date of Patent: Feb. 26, 2002

(54) PAPER FEED DEVICE AND AN IMAGE FORMING APPARATUS HAVING THE PAPER FEED DEVICE

(75) Inventor: Nobutaka Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/506,375

(22) Filed: Feb. 18, 2000

(30) Foreign Application Priority Data

Mar. 8, 1999 (JP) ..... 11-060498
Dec. 17, 1999 (JP) ..... 11-359108

(51) Int. Cl.[7] ..... B65H 1/24
(52) U.S. Cl. ..... 271/120; 271/126; 271/160; 271/148
(58) Field of Search ..... 271/126, 160, 271/161, 117, 119, 120, 148

(56) References Cited

U.S. PATENT DOCUMENTS 1,626,353 A * 4/1927 Olson ..... 271/148
4,473,221 A * 9/1984 Arai ..... 271/119 X
5,188,350 A * 2/1993 Hayashi ..... 271/119 X
5,419,645 A * 5/1995 Russo ..... 271/148
6,065,745 A * 5/2000 Casper et al. ..... 271/160

* cited by examiner

*Primary Examiner*—Joseph E. Valenza
*Assistant Examiner*—Mark A. Demble
(74) *Attorney, Agent, or Firm*—Oblon, Spivak, McClelland, Maier & Neustadt, P.C.

(57) ABSTRACT

A paper feed device includes paper feed rollers to feed a sheet of paper. A paper loading device is loaded with at least a sheet of paper and lifts the loaded sheet of paper toward the paper feed rollers. A pressure differences decreasing device is mounted on the paper loading device and decreases differences of pressures among a plurality of positions where the paper feed rollers contact the sheet of paper.

12 Claims, 9 Drawing Sheets

PAPER FEED DEVICE AND AN IMAGE FORMING APPARATUS HAVING THE PAPER FEED DEVICE

BACKGROUND OF THE INVENTION

1. Field of the Invention

The present invention relates to a paper feed device and an image forming apparatus having the paper feed device.

2. Discussion of the Background Art

FIG. 1 is schematic view illustrating a background paper feed device 20. The paper feed device 20 may be used, for example, in image forming apparatuses such as a photocopier, a facsimile machine, a printer, etc. Referring to the FIG. 1, the paper feed device 20 includes a paper feed roller 21 on a shaft 22, a paper separating device 25 having a friction pad 25F, and a paper tray 27 having a tray friction pad 23. The paper tray 27 loads a plurality of sheets of paper S. The paper feed roller 21 rotates in a clockwise direction so that a top sheet of papers S is fed toward the paper separating device 25. When plural sheets of papers are fed into the paper separating device 25 one at a time, the paper separating device 25 separates the top sheet from the other sheets and further transports the top sheet. The tray friction pad 23 prevents plural sheets of paper from being fed out at the same time, especially when the paper tray 27 loads a relatively small number of sheets, for example, such as twenty sheets or less.

In general, the outer surface of the paper feed roller 21 has substantially a cylindrical shape. The outer surface, however, may be worn by friction between the outer surface and the sheets of paper being fed out over a long period. In addition, the wear may not occur uniformly, and thereby the outer surface of the paper feed roller 21 may acquire a non-cylindrical shape. When the paper feed roller 21 has worn non-uniformly to acquire, for example, a cone shape, the pressure at a contacting point between the outer surface and a sheet of paper being fed out varies depending upon an axial position of the paper feed roller 21.

FIG. 2 is an explanatory graph illustrating a relationship between axial positions of a worn paper feed roller 21 and pressures against sheets of paper. In FIG. 2, the paper feed roller 21 has been worn into a barrel shape. As illustrated, the pressure at a contacting point between the outer surface and a sheet of paper being fed out varies depending upon the axial position of the paper feed roller 21 or depending upon a diameter of the outer surface of the paper feed roller 21 at that axial position. At a position where the diameter is large, the pressure has a large value denoted as P1, and at a position where the diameter is small, the pressure has a small value denoted as P2. Such a pressure difference P1–P2 may cause a malfunction in a paper feeding operation, such as a paper skew or a paper jam. The diameter of the outer surface of the paper feed roller 21 may also vary along an axial position of the paper feed roller 21 due to errors arising during the manufacture of the roller, and such errors may cause similar malfunctions.

When the paper feed roller 21 is damaged or worn out, the damaged or worn paper feed roller must be replaced by a new one. Generally, a worn paper feed roller is detached by pulling it out and a new roller is attached along a direction of the axis of the shaft 22. Therefore, a replacing operation of the paper feed roller requires a relatively long time, and a down time of an image forming apparatus using the paper feed device becomes relatively long.

SUMMARY OF THE INVENTION

The present invention has been made in view of the above-discussed and other problems and is intended to overcome the above-discussed and other problems associated with the background methods and apparatus. Accordingly, one object of the present invention is to provide a novel paper feed device and an image forming apparatus having the paper feed device that can perform a quality paper feeding operation for a relatively long period.

Another object of the present invention is to provide a novel paper feed device and an image forming apparatus having the paper feed device for which a maintenance operation can be performed in a relatively short time.

To achieve these and other objects, the present invention provides a novel paper feed device and an image forming apparatus having the paper feed device which includes paper feed rollers to feed a sheet of paper. A paper loading device loads at least a sheet of paper and lifts the loaded sheet of paper toward the paper feed rollers. A pressure differences decreasing device is mounted on the paper loading device and decreases differences of pressures among a plurality of positions where the paper feed rollers contact the sheet of paper.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
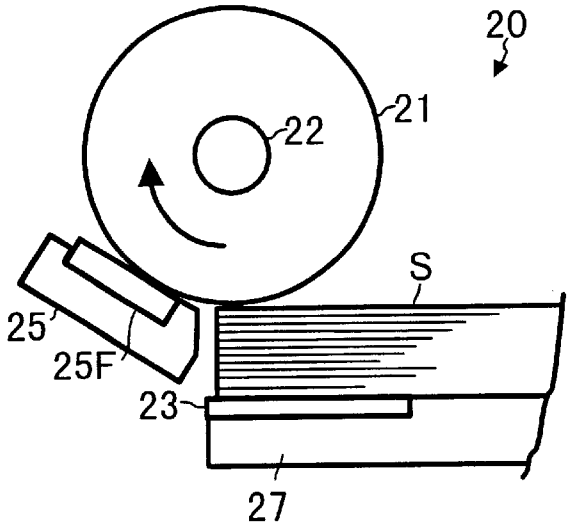
FIG. 1 Prior Art
FIG. 1 is a schematic view illustrating a background paper feed device.
Figure 2:
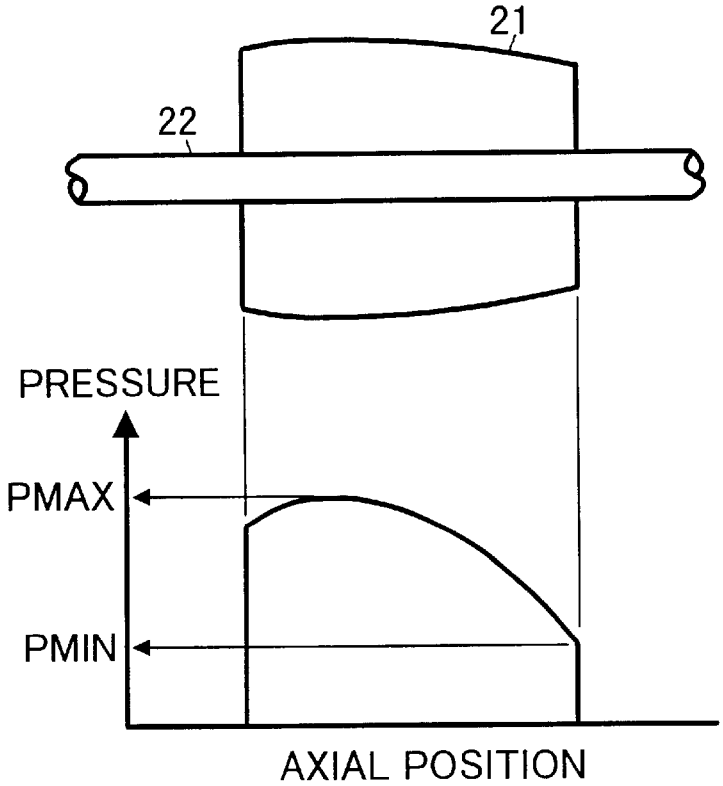
FIG. 2 Prior Art
FIG. 2 is an explanatory graph illustrating a relationship between axial positions of a worn paper feed roller and pressure against paper of the background paper feed device of FIG. 1.
Figure 3:
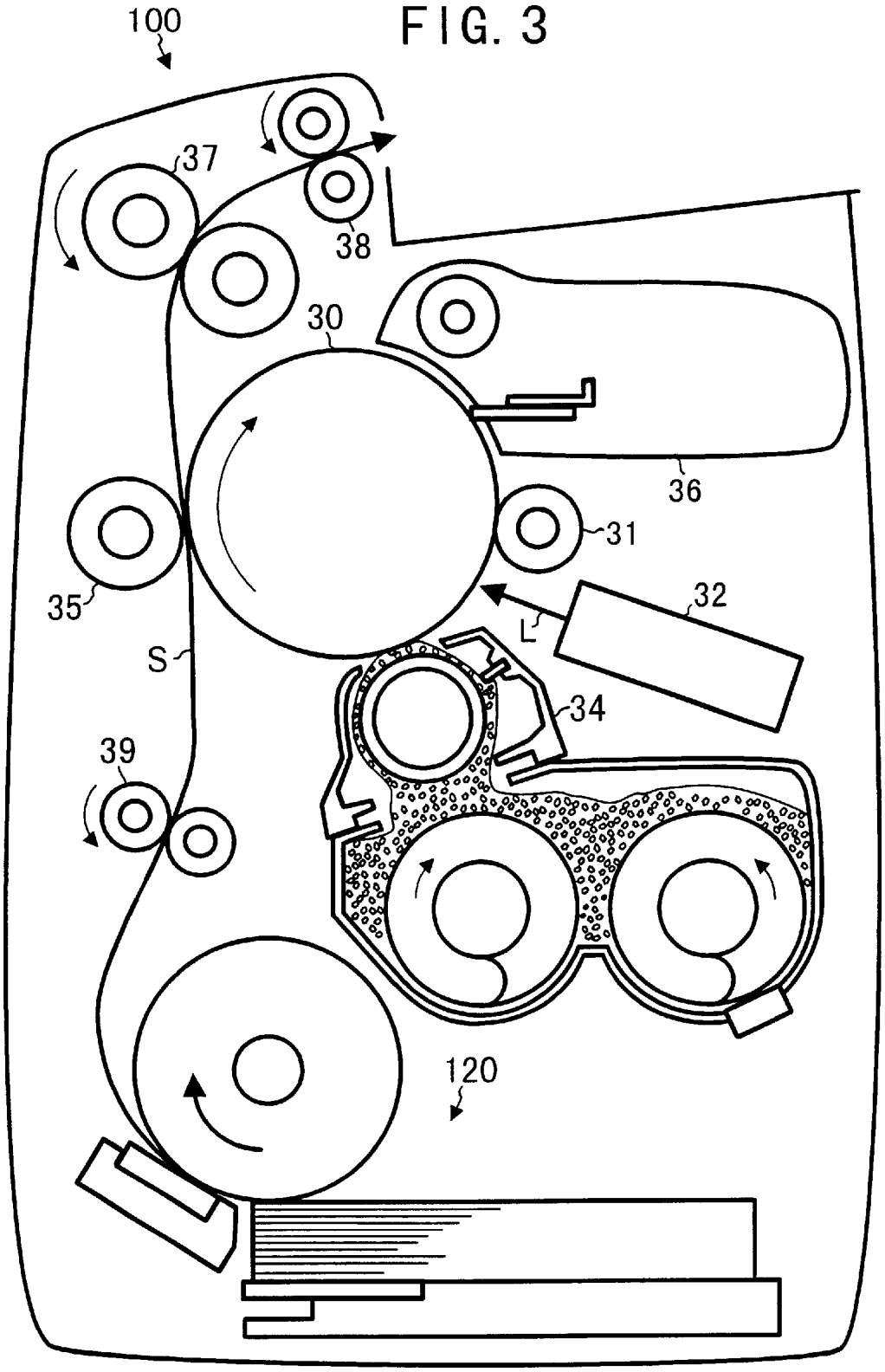
FIG. 3 is a schematic view illustrating a laser printer provided with a paper feed device as an example configured according to the present invention.

Referring now to the drawings, wherein like reference numerals designate identical or corresponding parts throughout the several views, and more particularly to FIG. 3 thereof, a schematic view illustrates a laser printer 100 provided with a paper feed device 120 as an example configured according to the present invention. The laser printer 100 includes a photoconductive drum 30 as an image bearer surrounded by an electrical charging roller 31, a raster scanning module 32, a developing device 34, an image transfer device 35 and a cleaning device 36. The laser printer 100 also includes a register roller pair 39, a fixing device 37, an exit roller pair 38 and the paper feed device 120.

An image forming operation is performed as follows. A control module of the laser printer 100 receives a print command accompanying print data from an external apparatus such as a personal computer. Then the control module activates the photoconductive drum 30 to rotate clockwise. The electrical charging device 31 charges the surface of the photoconductive drum 30 at a substantially uniform voltage. The charged photoconductive drum 30 is then exposed by the raster scanning module 32 with a raster scanning laser beam denoted as "L" according to the received print data. Thus, an electrostatic latent image according to the received print data is formed on the photoconductive drum 30.

Then the developing device 34 develops the electrostatic latent image, and thus a toner image according to the print data is formed on the photoconductive drum 30. The toner image is then conveyed to a position opposing the image transfer device 35. Meanwhile, a sheet of paper S is conveyed by the paper feed device 120 to the position where the image transfer device 35 opposes the photoconductive drum 30. While the sheet S is conveyed at a substantially identical speed to the circumferential speed of the photoconductive drum 30, a power supply supplies the image transfer device 35 with an appropriate image transfer voltage. Thereby, the toner image on the photoconductive drum 30 is attracted toward the sheet S and transferred to the sheet S.

The sheet S having the transferred toner image is further conveyed to the fixing device 37 where the toner image is fixed on the sheet S, and then the sheet S is discharged outside the laser printer 100 as a printed sheet.

Figure 4:
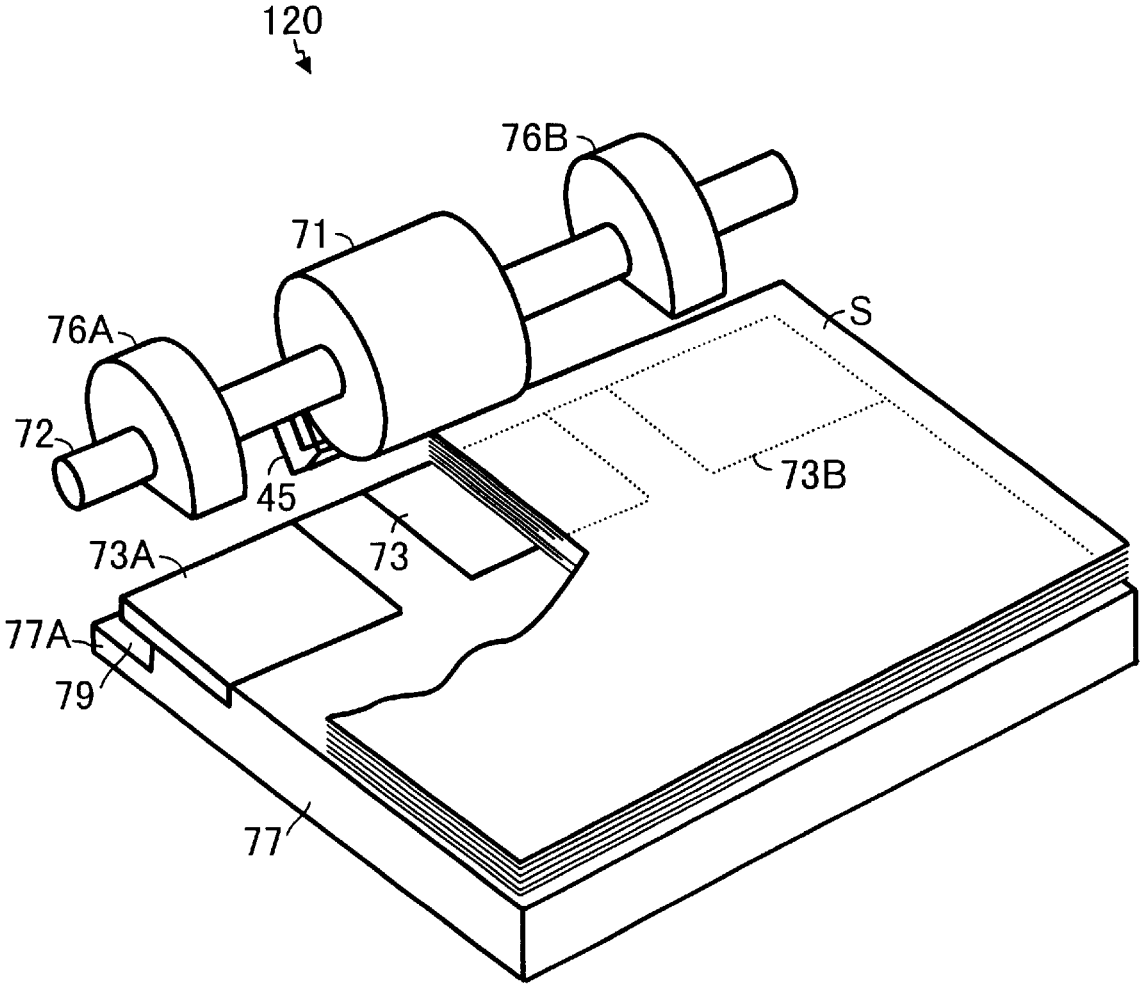
FIG. 4 is a schematic view illustrating a paper feed device as an example configured according to the present invention.

FIG. 4 is a schematic view illustrating the paper feed device 120 of FIG. 3 as an example configured according to the present invention. The paper feed device 120 includes a main paper feed roller 71, and auxiliary paper feed rollers 76A and 76B on a shaft 72, a paper separating device 45 having a friction pad 45F, and a paper tray 77 as a paper loading device having elastic pads 73, 73A and 73B, a recess 79, and a limiting member 77A.

The paper tray 77 is loaded with a sheet or plural sheets of paper and is lifted toward the paper feed rollers 71, 76A and 76B, together with the loaded paper, with an appropriate force by a lifting mechanism which is well known and will not be further described. The elastic pads 73, 73A and 73B function as pressure difference decreasing devices and may be made of, for example, a rubber material or a relatively soft plastic material. Portions of the elastic pads 73, 73A and 73B are attached to the paper tray 77 by, for example, an adhesive. The other portions of the elastic pads 73, 73A and 73B are overhung in the recess 79.

A sectional shape of the auxiliary paper feed rollers 76A and 76B may be a half moon shape as illustrated in FIG. 4 or a round shape. A sectional shape of the main paper feed roller 71 is round in this example, however it may also be a half moon shape. The main paper feed roller 71 and auxiliary paper feed rollers 76A and 76B rotate in a clockwise direction so that a top sheet of paper S is fed thereby toward the paper separating device 45. When plural sheets of paper are to be fed to the paper separating device 45 one at a time, the paper separating device 45 separates a top sheet from the remaining sheets and transports the top sheet.

Figure 5A:
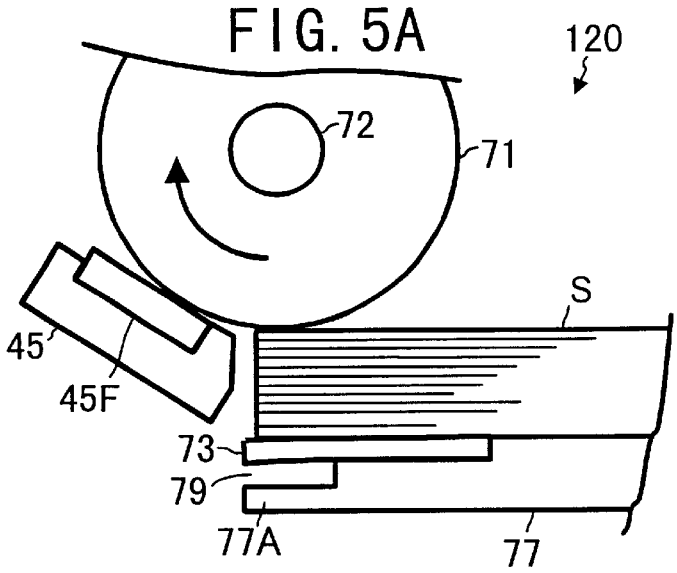
FIG. 5A is a schematic sectional view illustrating the paper feed device of FIG. 4 with a relatively large number of sheets of paper.
Figure 5B:
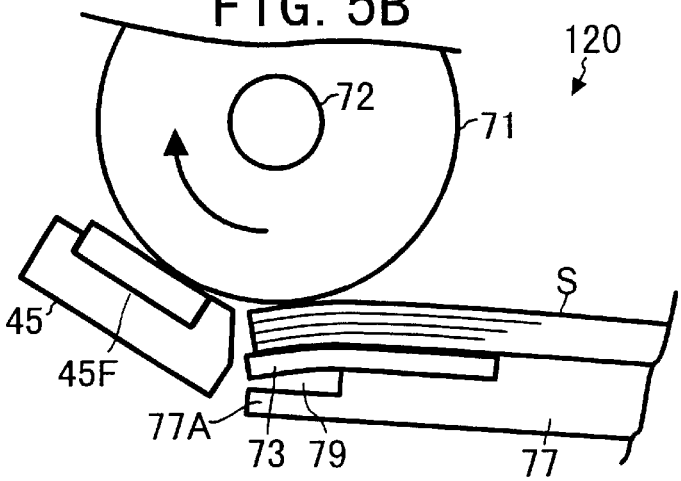
FIG. 5B is a schematic sectional view illustrating the paper feed device of FIG. 4 with a medium number of sheets of paper.
Figure 5C:
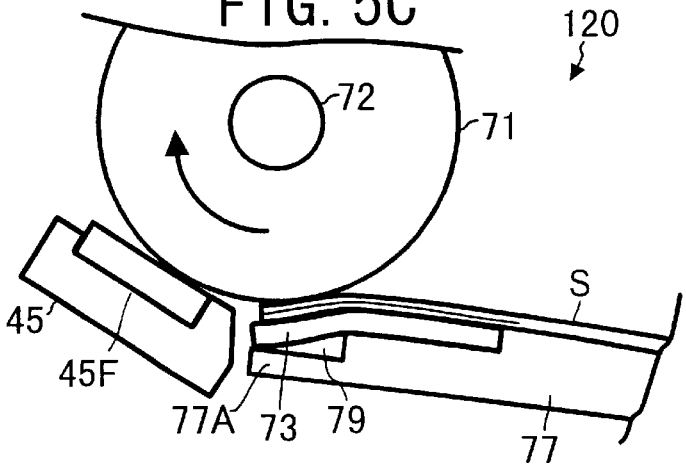
FIG. 5C is a schematic sectional view illustrating the paper feed device of FIG. 4 with a relatively small number of sheets of paper.

FIG. 5A, FIG. 5B and FIG. 5C are schematic sectional views illustrating the paper feed device of FIG. 4 with a relatively large number of sheets, a medium number of sheets, and a relatively small number of sheets of paper, respectively. As illustrated in FIG. 5A, when the paper tray 77 is loaded with a relatively large number of sheets, for example one hundred sheets or more, the elastic pads 73, 73A and 73B bend with a relatively small quantity of distortion. When the paper tray 27 is loaded with a medium number of sheets, for example fifty sheets, the elastic pads 73, 73A and 73B bend with a medium quantity of distortion as illustrated in FIG. 5B. When the paper tray 27 is loaded with a relatively small number of sheets, for example twenty or fewer sheets, the elastic pads 73, 73A and 73B bend with a large quantity of distortion as illustrated in FIG. 5C and contact the limiting member 77A. The limiting member 77A limits the bending of the elastic pads 73, 73A and 73B.

Figure 6:
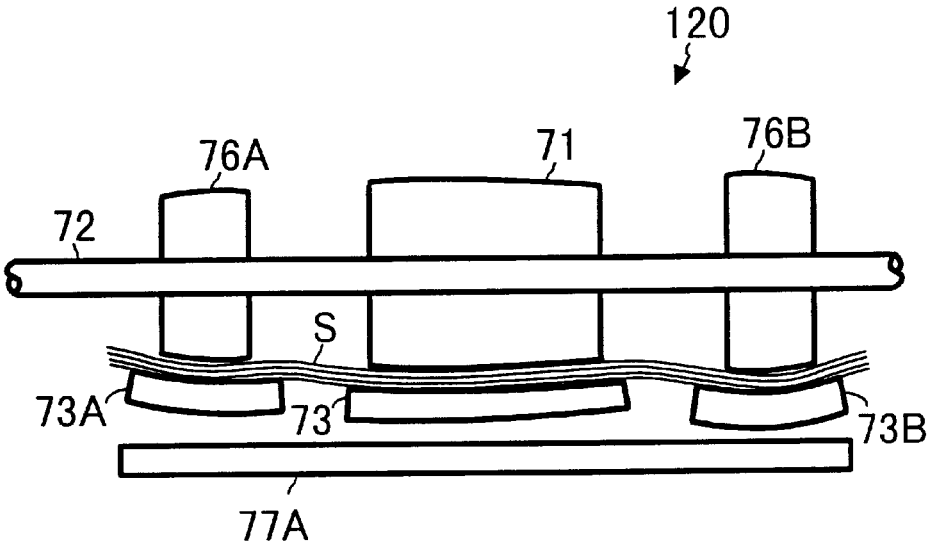
FIG. 6 is a schematic sectional view in an axial direction of the paper feed roller illustrating the paper feed device of FIG. 4.

FIG. 6 is a schematic sectional view in an axial direction of the paper feed roller illustrating the paper feed device 120 of FIG. 4. When the main paper feed roller 71 and the auxiliary paper feed rollers 76A and 76B have been worn unevenly as illustrated in FIG. 6, the elasticity of the elastic pads 73, 73A and 73B allows the sheets of paper S to follow the outer surface of the paper feed rollers 71, 76A and 76B. Therefore, pressures per unit area between the sheets S and the paper feed rollers 71, 76A and 76B are made relatively uniform in comparison with background paper feed devices, which do not provide such elastic pads.

Figure 7:
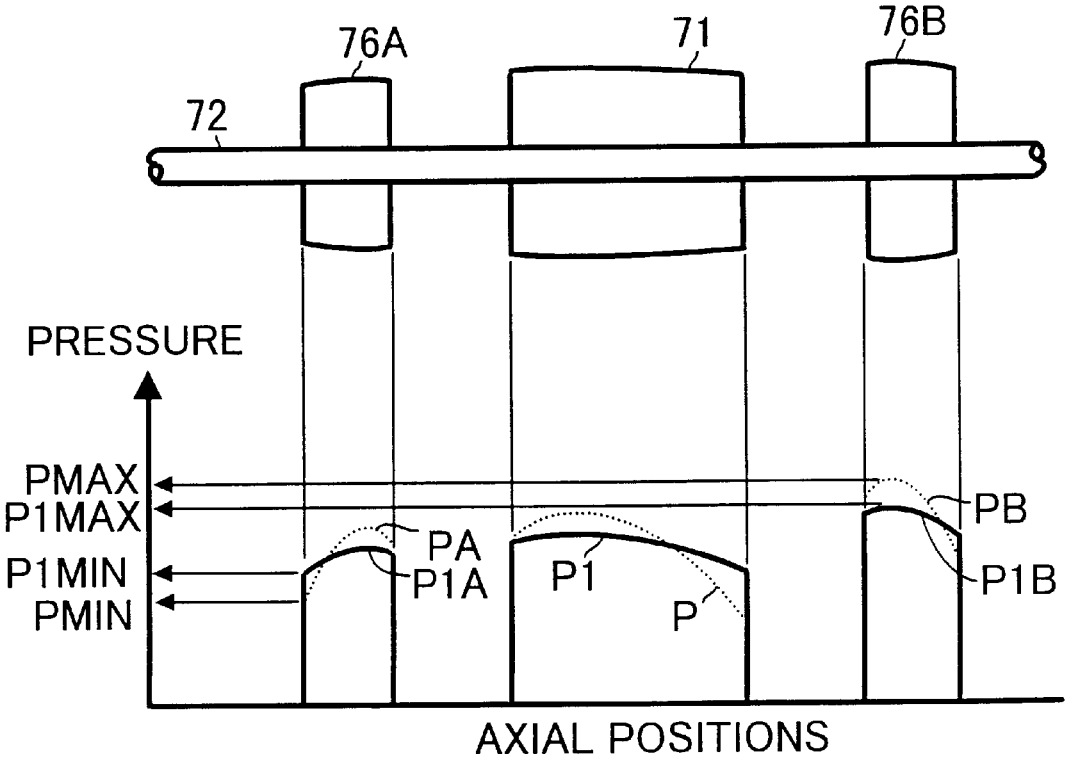
FIG. 7 is an explanatory graph illustrating a relationship between axial positions of worn paper feed rollers and pressures against sheets of paper of the paper feed device of FIG. 4.

FIG. 7 is an explanatory graph illustrating a relationship between axial positions of worn paper feed rollers 71, 76A and 76B and pressures per unit area against sheets of paper S in the paper feed device 120 of FIG. 4. In FIG. 7, the auxiliary paper feed roller 76A is the most worn roller, i.e., the auxiliary paper feed roller 76A has the smallest diameter, and the auxiliary paper feed roller 76B is the least worn roller, i.e., the auxiliary paper feed roller 76B has the largest diameter. Solid line curves denoted as P1, P1A and P1B illustrate pressures per unit area against sheets of paper in the paper feed device 120, each corresponding to a different axial position of the paper feed rollers. Doted line curves denoted as P, PA and PB illustrate pressures against sheets of paper in a background paper feed device as a reference.

In the background paper feed device, the maximum pressure is denoted as PMAX and the minimum pressure is denoted as PMIN. In the paper feed device 120 of the present invention, the maximum pressure is denoted as P1MAX and the minimum pressure is denoted as P1MIN. The pressure P1MAX is smaller than the pressure PMAX and the pressure P1MIN is larger than the pressure PMIN. That is, a pressure difference PMAX-PMIN is reduced to a difference P1MAX-P1MIN, and therefore a malfunction in a paper feed operation caused by uneven diameters of the paper feed rollers is reduced. In other words, a quality paper feed operation can last a relatively long term or the durability of the paper feed rollers 71, 76A and 76B is increased in comparison with background paper feed device.

Figure 8:
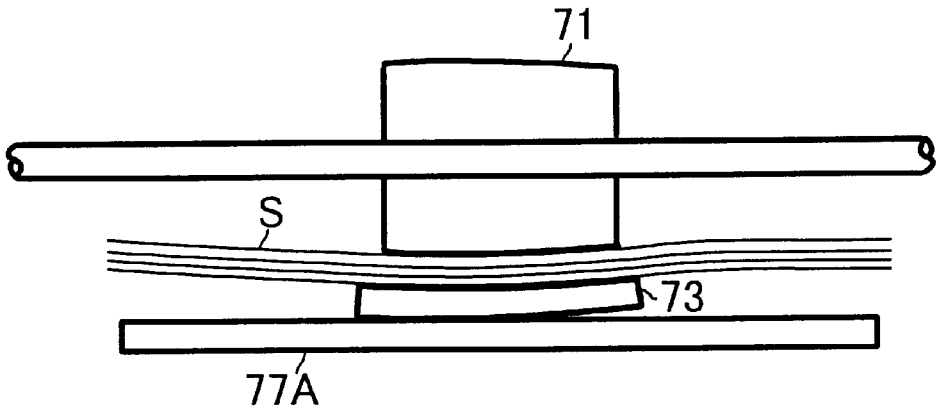
FIG. 8 is a schematic sectional view illustrating a paper feed device having a single paper feed roller.

In the paper feed device 120 of FIG. 4, the auxiliary paper feed rollers 76A and 76B may be omitted. FIG. 8 is a schematic sectional view illustrating such a paper feed device having a single paper feed roller 71. In FIG. 8, the paper feed roller 71 has been worn unevenly. However, sheets of paper S may follow the outer surface of the paper feed roller 71, and thereby a deviation of pressure between the sheet S and the roller is also decreased.

Figure 9:
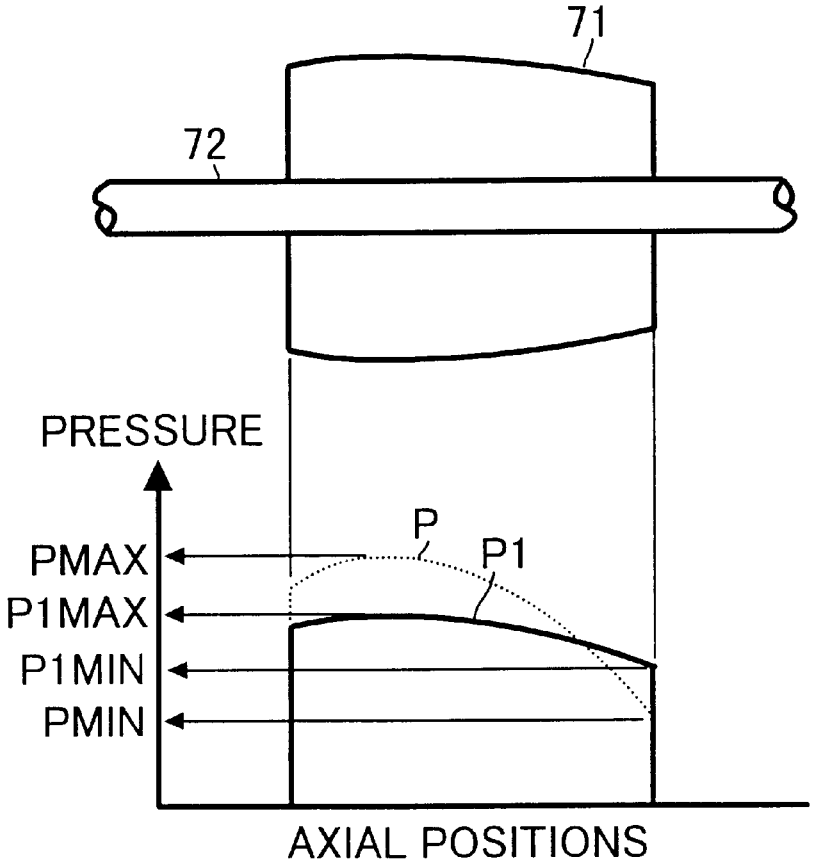
FIG. 9 is an explanatory graph illustrating a relationship between axial positions of the single paper feed roller and pressures against sheets of paper of the paper feed device of FIG. 8.

FIG. 9 is an explanatory graph illustrating a relationship between axial positions of a paper feed roller 71 and pressures against sheets of paper of a paper feed device having the single paper feed roller 71. A solid line curve denoted as P1 illustrates pressures per unit area against sheets of paper of the paper feed device corresponding to different axial positions of the paper feed roller 71. A dotted line curve denoted as P illustrates pressures against sheets of paper of a background paper feed device as a reference. In the paper feed device having a single paper feed roller of the present invention, the maximum pressure is denoted as P1MAX and the minimum pressure is denoted as P1MIN. In the background paper feed device with a single paper feed roller, the maximum pressure is denoted as PMAX and the minimum pressure is denoted as PMIN. A pressure difference PMAX-PMIN is reduced to a difference P1MAX-P1MIN, and therefore a malfunction in a paper feed operation is also reduced.

Figure 10:
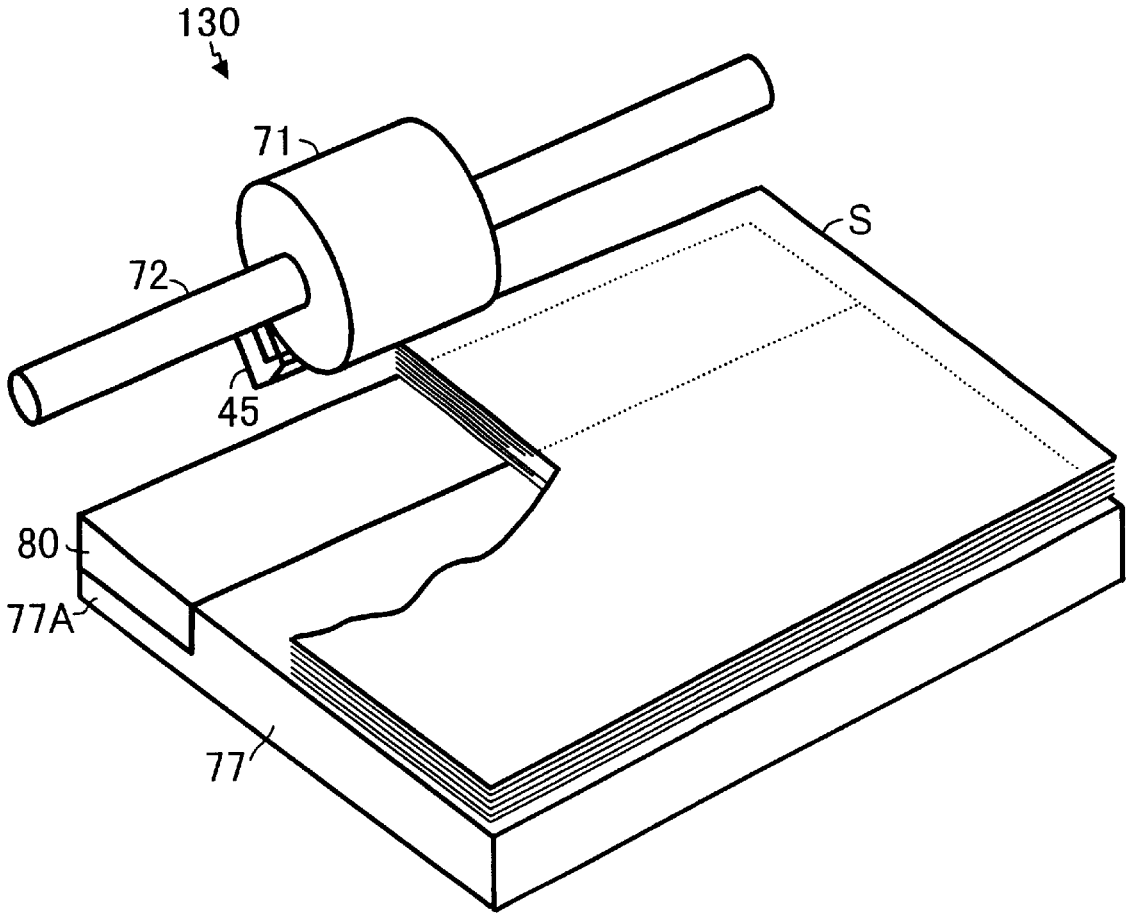
FIG. 10 is a schematic sectional view illustrating a paper feed device as another example configured according to the present invention.

FIG. 10 is a schematic sectional view illustrating a paper feed device 130 as another example configured according to the present invention. In FIG. 10, the elements that are substantially the same as those in FIG. 4 are denoted by the same reference numerals. A description of the same elements in FIG. 10 as in FIG. 4 is not provided to avoid redundancy. With reference to FIG. 10, the paper tray 77 is provided with an elastic block 80 mounted on the limiting member 77A. The elastic block 80 may be softer and/or thicker than the elastic pad 73 of FIG. 4.

Figure 11A:
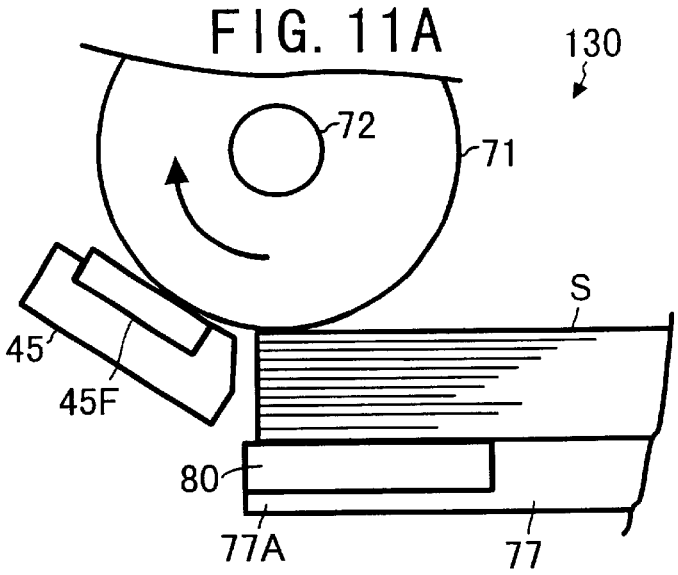
FIG. 11A is a schematic sectional view illustrating a schematic sectional view illustrating the paper feed of FIG. 10 with a relatively large number of sheets of paper.
Figure 11B:
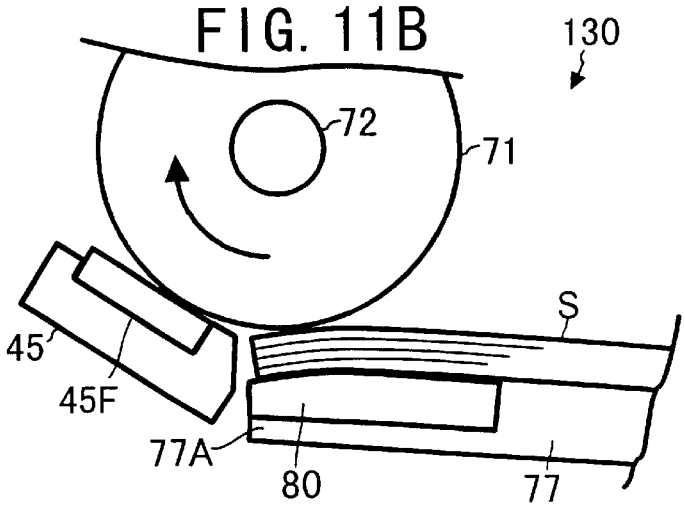
FIG. 11B is a schematic sectional view illustrating the paper feed device of FIG. 10 with a medium number of sheets of paper.
Figure 11C:
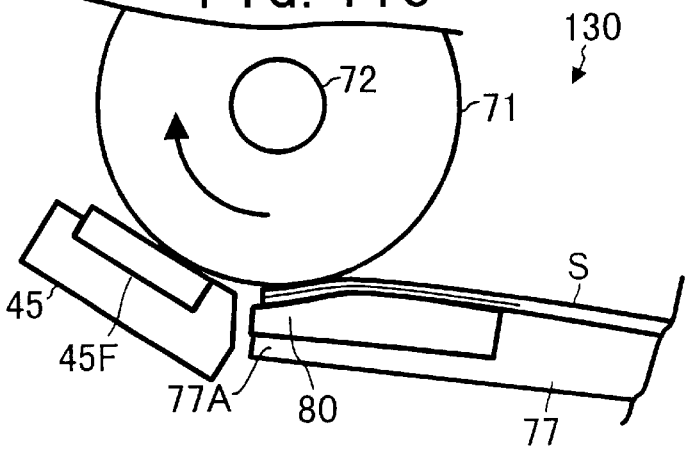
FIG. 11C is a schematic sectional view illustrating the paper feed device of FIG. 10 with a relatively small number of sheets of paper.

FIG. 11A is a schematic sectional view illustrating the paper feed device 130 of FIG. 10 with a relatively large number of sheets of paper. FIG. 11B and FIG. 11C are schematic sectional views illustrating the paper feed device 130 of FIG. 10 with a medium number of sheets of paper and a relatively small number of sheets of paper, respectively. With reference to FIG. 11A, when the paper tray 77 is loaded with a relatively large number of sheets, for example one hundred sheets or more, the elastic block 80 is compressed and distorted by a relatively small quantity of distortion. With reference to FIG. 11B, when the paper tray 77 is loaded with a medium number of sheets, for example fifty sheets, the elastic block 80 is further compressed and distorted in a medium quantity of distortion. With reference to FIG. 11C, when the paper tray 77 is loaded with a relatively small number of sheets, for example twenty or fewer sheets, the elastic block 80 is still further compressed and distorted by a large quantity of distortion.

Thus, a pressure difference caused by different diameters of the paper feed rollers is reduced, and thereby a malfunction in a paper feed operation, such as paper skews or paper jams caused by differences in diameters, are reduced.

Figure 12:
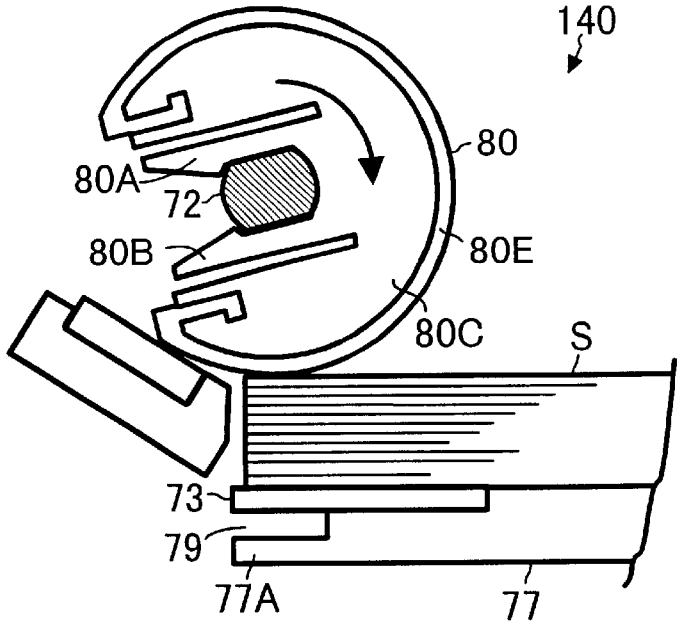
FIG. 12 is a schematic sectional view illustrating a paper feed device as still another example configured according to the present invention.

After a certain period of paper feed operation, even the above-described paper feed device may not compensate a relatively large quantity of uneven wear of a paper feed roller. In such a case, the present invention provides a paper feed device whose paper feed roller is capable of being replaced in a relatively short time. FIG. 12 is a schematic sectional view illustrating a paper feed device 140 as still another example configured according to the present invention. In FIG. 12, the elements that are substantially the same as those in FIG. 4 are denoted by the same reference numerals.

Referring to FIG. 12, the paper feed device 140 includes a detachable paper feed roller 80 and a shaft 72 having cut flat surfaces onto which the paper feed roller fits. The paper feed roller 80 is structured with a core 80C and an outer layer 80E. The outer layer 80E may be made of rubber and is fit onto the outer surface of the core 80C. The core 80C may be made of a plastic material and includes a yoke having elastic fingers 80A and 80B. Thus, the paper feed roller 80 is fit onto the shaft 72 at the cut flat surface portions.

Figure 13:
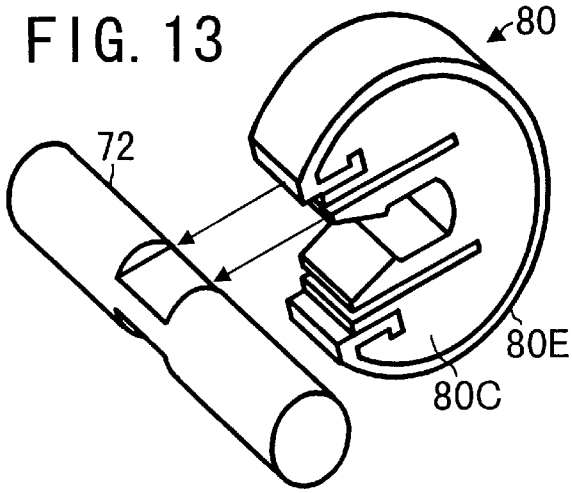
FIG. 13 is a schematic view illustrating the paper feed roller and the shaft of FIG. 12.

FIG. 13 is a schematic view illustrating the paper feed roller 80 and the shaft 72 of FIG. 12. The paper feed roller 80 is snapped on along directions of the arrows illustrated in FIG. 13. When the paper feed roller 80 is snapped on the shaft 72, the fingers 80A and 80B of the yoke hold the paper feed roller 80 so as not to pull out during paper feed operations.

Figure 14:
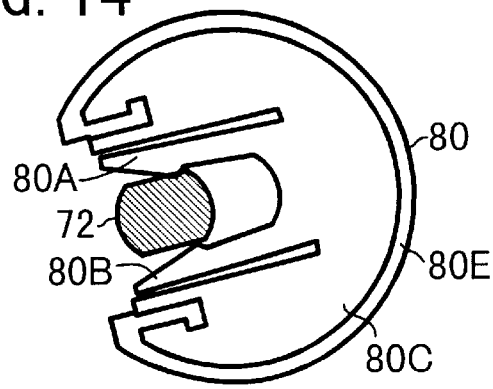
FIG. 14 is a schematic view illustrating the paper feed roller of FIG. 12 during a replacing operation.

FIG. 14 is a schematic view illustrating the paper feed roller 80 of FIG. 12 during a replacing operation. When the paper feed roller 80 is pulled with a certain force, the fingers 80A and 80B of the yoke can expand to trip off from the shaft 72.

As described above, the paper feed roller 80 can be replaced by a pulling out operation and pushing in operation, so that the replacing operation can be performed in a relatively short time in comparison with a replacing operation for the background paper feed device. In other words, a down time of an image forming apparatus having the paper feed device 140 is decreased. Further, the replacing operation of the paper feed roller 80 is relatively simple, and therefore ordinary users of the image forming apparatus can replace the paper feed roller instead of calling a service person, so that a down time of the image forming apparatus may be further shortened.

As described above, the novel paper feed device and an image forming apparatus having the paper feed device can perform a quality paper feeding operation for a relatively long period. Further, the novel paper feed device and an image forming apparatus having the paper feed device can have a maintenance operation of the paper feed device performed in a relatively short time.

Obviously, numerous modifications and variations of the present invention are possible in light of the above teachings. For example, features described for certain embodiments may be combined with other embodiments described herein. It is therefore to be understood that within the scope of the appended claims, the invention may be practiced otherwise than as specifically described herein.

This document is based on Japanese Patent application No. 11-060498 filed in the Japanese Patent Office on Mar. 8, 1999 and Japanese Patent application No. 11-359108 filed in the Japanese Patent Office on December 17, the entire contents of which are incorporated herein by reference.

What is claimed as new and desired to be secured by Letters Patents of the United States:

1. A paper feed device comprising:

paper feed rollers;

a paper loading device configured to be loaded with at least a sheet of paper and lift the loaded sheet of paper toward the paper feed rollers; and a pressure difference decreasing device mounted on the paper loading device and configured to decrease differences of pressures among a plurality of positions where the paper feed rollers contact the sheet of paper.

2. The paper feed device according to claim 1, wherein the paper feed rollers comprise a main paper feed roller, a first auxiliary paper feed roller concentrically mounted on the axis of the main paper feed roller at one side of the main paper feed roller, and a second auxiliary paper feed roller concentrically mounted on the axis of the main paper feed roller at another side of the main paper feed roller.

3. The paper feed device according to claim 1, wherein the pressure difference decreasing device comprises an elastic pad.

4. The paper feed device according to claim 3, wherein the pressure difference decreasing device comprises a recess in the paper loading device and disposed at an end of the paper loading device, and a portion of the elastic pad positioned to bend in the recess under a pressure.

5. The paper feed device according to claim 4, wherein the pressure difference decreasing device further comprises a limiting member disposed at the bottom of the recess.

6. The paper feed device according to claim 1, wherein the pressure difference decreasing device comprises an elastic block.

7. The paper feed device according to claim 1, wherein the pressure difference decreasing device comprises a recess in the paper loading device and disposed at an end of the paper supporting device, and an elastic block disposed in the recess.

8. The paper feed device according to claim 1, wherein at least one of the paper feed rollers is configured to be dismountably attached on a shaft.

9. The paper feed device according to claim 1, wherein at least one of the paper feed rollers is configured to be dismountably attached on a shaft in a direction that substantially crosses an axis of the shaft.

10. An image forming apparatus comprising a paper feed device comprising:

paper feed rollers;

a paper loading device configured to be loaded with at least a sheet of paper and lift the loaded sheet of paper toward the paper feed rollers; and a pressure difference decreasing device mounted on the paper loading device and configured to decrease differences of pressures among a plurality of positions where the paper feed rollers contact the sheet of paper.

11. A paper feed device comprising:

paper feed means for feeding a sheet of paper;

paper loading means for being loaded with at least a sheet of paper and lifting the loaded sheet of paper toward the paper feed means; and pressure difference decreasing means on the paper loading means for decreasing differences of pressures among a plurality of positions where the paper feed means contacts the sheet of paper.

12. An image forming apparatus comprising a paper feed device comprising:

paper feed means for feeding a sheet of paper;

paper loading means for being loaded with at least a sheet of paper and lifting the loaded sheet of paper toward the paper feed means; and pressure difference decreasing means on the paper loading means for decreasing differences of pressures among a plurality of positions where the paper feed means contacts the sheet of paper.

* * * * *